US006571995B2

(12) United States Patent
Lee

(10) Patent No.: US 6,571,995 B2
(45) Date of Patent: Jun. 3, 2003

(54) SPOUT ASSEMBLY FOR LIQUID CONTAINER

(76) Inventor: Jung Min Lee, #705, Hosan Plaza Apt., 37, Samsung-dong, Kangnam-gu, Seoul (KR), 135-092

( * ) Notice: Subject to any disclaimer, the term of this patent is extended or adjusted under 35 U.S.C. 154(b) by 0 days.

(21) Appl. No.: 09/980,550

(22) PCT Filed: Mar. 5, 2001

(86) PCT No.: PCT/KR01/00337

§ 371 (c)(1),
(2), (4) Date: Nov. 2, 2001

(87) PCT Pub. No.: WO01/66418

PCT Pub. Date: Sep. 13, 2001

(65) Prior Publication Data

US 2002/0134802 A1 Sep. 26, 2002

(30) Foreign Application Priority Data

Mar. 5, 2000 (KR) ..... 2000-11395
Mar. 6, 2000 (KR) ..... 2000-12196

(51) Int. Cl.[7] ..... B67D 3/00

(52) U.S. Cl. ..... 222/527; 222/529; 222/464.1; 222/464.3; 222/481.5

(58) Field of Search ..... 222/527, 529, 222/481.5, 464.3, 464.1

(56) References Cited

U.S. PATENT DOCUMENTS 2,786,606 A * 3/1957 Dushek et al. ..... 222/156
4,073,413 A * 2/1978 Tabler et al. ..... 222/529
4,236,655 A * 12/1980 Humphries ..... 222/465
4,351,454 A * 9/1982 Maynard, Jr. ..... 222/143
4,407,425 A * 10/1983 Combs ..... 220/269
4,492,324 A * 1/1985 Weber ..... 222/529
4,602,728 A * 7/1986 Ha ..... 222/528
4,856,664 A * 8/1989 Gillispie et al. ..... 215/31
5,054,631 A * 10/1991 Robbins, III ..... 215/1
5,097,994 A * 3/1992 Washam ..... 222/527
5,133,481 A * 7/1992 Mayfield ..... 222/466
5,624,062 A * 4/1997 Pedersen et al. ..... 222/528
5,647,516 A * 7/1997 Young et al. ..... 222/529
5,671,863 A * 9/1997 Uliana ..... 220/710
5,722,570 A * 3/1998 Sultzer, III et al. ..... 222/529
5,931,349 A * 8/1999 Yoo ..... 222/146.5
5,934,522 A * 8/1999 Canela et al. ..... 222/527
5,975,380 A * 11/1999 West, Jr. ..... 222/529
6,026,994 A * 2/2000 Rigel ..... 222/538
6,112,949 A * 9/2000 Rhodes et al. ..... 222/153.02
6,227,403 B1 * 5/2001 Kim ..... 220/707
6,435,383 B1 * 8/2002 Lee ..... 222/522

FOREIGN PATENT DOCUMENTS

DE 3906323 A1 * 9/1989 ..... B65D/25/48

* cited by examiner

*Primary Examiner*—Ehud Gartenberg
*Assistant Examiner*—Frederick C. Nicolas
(74) *Attorney, Agent, or Firm*—Norris McLaughlin & Marcus

(57) ABSTRACT

A spout assembly for a liquid container includes a tube-shaped main body formed on a container cap and projected upward by a predetermined length, an operating tube inserted into the tube-shaped main body and extending into a container by a predetermined length, and a spout seal cap fitted on an upper portion of the tube-shaped main body. So as to enable the tube-shaped main body and the operating tube moves between a first position where the main body and the operating tube can be vertically erected on a surface of the container cap and a second position where the main body and the operating tube can be secured parallel to the surface of the container cap, a first pleated expansible and flexible part is provided on the main body and a second pleated expansible and flexible part is provided on the operating tube to correspond to the first pleated expansible and flexible part.

18 Claims, 10 Drawing Sheets

SPOUT ASSEMBLY FOR LIQUID CONTAINER

FIELD OF THE INVENTION

The present invention relates to a spout assembly for a liquid container, and more particularly, to a spout assembly for a liquid container that is designed to (a) easily dispense liquid beverages contained in the container into another container such as a cup, (b) enable easy and convenient drinking of the liquid beverages contained in the container, and (c) be secured to a top surface of the container in parallel with the same so as to save space when the containers to which the spout assemblies are applied are packaged in a box, etc. for distribution.

DESCRIPTION OF THE RELATED ART

Generally, a liquid container with a spout assembly is designed such that it is vertically projected out of a top surface of the container. This makes it ill Impossible to stack the liquid containers in a multi-layer configuration. Even if such multi-layer stacking is possible, the containers occupy much space because of the projected spout assembly.

In addition, the liquid container with the spout assembly is sealed and the spout assembly comprises an elongated tube extending to the interior of the liquid container so that the user can draw the liquid contained the container through the elongated tube in the manner that a straw is used. Such a structure is unfavorable for dispensing the liquid contained in the container into a cup. That is, the liquid in the container is incompletely discharged from the container because the spout has the elongated tube structure extending far into the interior of the container, thereby enabling access to only a portion of the liquid in the container.

SUMMARY OF THE INVENTION

Therefore, the present invention has been made in an effort to solve the above-described problems.

It is a first objective of the present invention to provide a spout assembly for a liquid container, which is flexible between at least a first position where the spout assembly can be vertically erected on a top surface of the container or a container cap and a second position where the spout assembly can be secured on a top surface of the container in parallel with the same so that the liquid containers to which the spout assemblies are employed can be stacked on one another, thereby saving space.

It is a second objective of the present invention to provide a spout assembly for a liquid container, which is designed to easily dispense the liquid beverage contained in the container into another container such as a cup, and to enable the easy and convenient drinking of the liquid beverage contained in the container.

To achieve the first objective, the present invention provides a spout assembly for a liquid container, which comprises a tube-shaped main body formed on a container cap and projected upward by a predetermined length, an operating tube inserted into the tube-shaped main body and extending into a container by a predetermined length, a spout seal cap fitted on an upper portion of the tube-shaped main body, and means for moving the tube-shaped main body and the operating tube between a first position where the main body and the operating tube can be vertically erected on a surface of the container cap and a second position where the main body and the operating tube can be secured parallel to the surface of the container cap.

Preferably, the means for moving comprises a first pleated expansible and flexible part provided on the main body and a second pleated expansible and flexible part provided on the operating tube to correspond to the first pleated expansible and flexible part.

Preferably, the tube-shaped main body is provided with an assembling flange at it lower end, the assembling flange being assembled on the container cap around an opening formed on the container cap. The assembling flange is attached on one of inner and outer surfaces of the container cap.

The spout seal cap comprises a seal wall close-tightly contacting an upper outer wall of the tube-shaped main body and an inner thread formed below the seal wall and engaged with an outer thread formed on the tube-shaped main body. The spout seal cap further comprises an opening identification skirt formed below the inner thread and engaged under an outer circumference protrusion formed on the main body below the outer thread.

To achieve the second objective, the operating tube is provided with a through hole and the main body is provided with a through hole closing wall, the through hole selectively communicating with an interior of the container or being closed by the through hole closing wall according to a vertical movement of the operating tube.

Preferably, the operating tube is further provided with a stopper protrusion formed below the through hole, the stopper protrusion preventing the operating tube from being completely removed from the container and allowing the through hole to be exactly located and closed by the through hole closing wall of the main body when the operating tube is pulled out of the container.

Further preferably, the operating tube is further provided with an elongated air introducing slot extending from a portion above the upper end of the main body to a portion below the stopper protrusion.

BRIEF DESCRIPTION OF THE DRAWINGS

Other objectives and aspects of the invention will become apparent from the following description of the embodiments with reference to the accompanying drawings in which.

DETAILED DESCRIPTION OF THE PREFERRED EMBODIMENTS

Figure 1A:
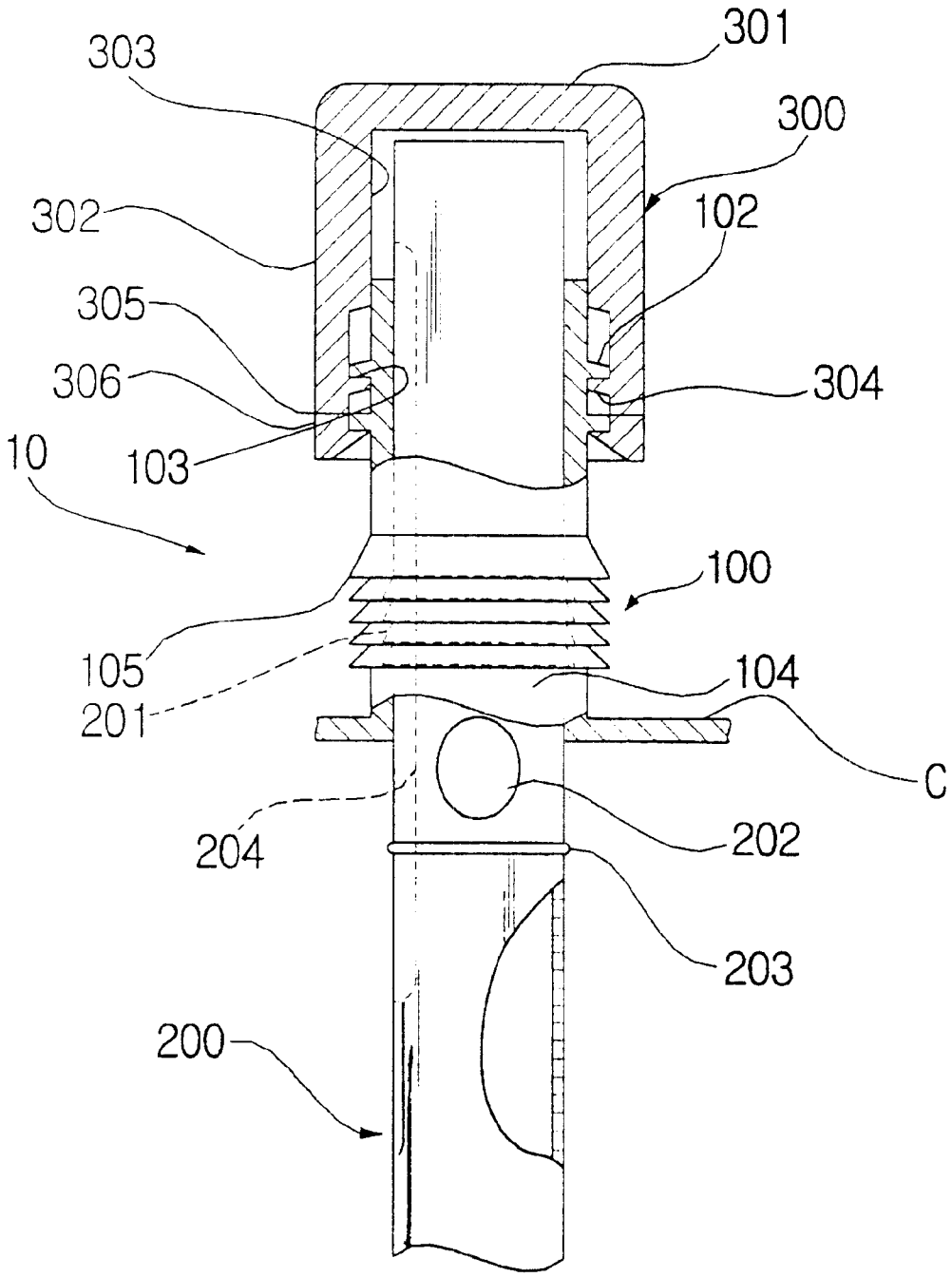
FIG. 1*a* partially sectional side view of a spout assembly for a liquid container according to a first embodiment of the present invention, in which the spout assembly is vertically erected on a top surface of the container or a container cap.

Preferred embodiments of the present invention will be described more in detail with referent to the accompanying drawings. In the description, the same reference numerals will be applied to the same parts throughout the drawings.

Referring first to FIG. 1*a*, there is shown a spout assembly according to a first embodiment of the present invention.

A spout assembly 10 of this embodiment comprises a tube-shaped main body 100 integrally formed with a top of a container cap C and projected upward by a predetermined length, an operating tube 200 inserted into the tube-shaped main body 100 and extending into a container (not shown) by a predetermined length to function as a straw, and a spout seal cap 300 fitted on an upper portion of the tube-shaped main body 100. The tube-shaped main body 100 is provided with an outer thread 102 formed in the vicinity of an upper end thereof and an outer circumference protrusion 103 formed below the outer thread 102. The tube-shaped main body 100 is further provided with a pleated expansible and flexible part 105. A portion of the tube-shaped main body 100 between the pleated expansible and flexible part 105 and the top of the container cap C is defined as a through-hole closing wall 104.

The spout seal cap 300 comprises a closed upper end portion 301 and a side portion 302 extending downward from the closed upper end portion 301. The side portion 302 is provided with a seal wall 303 close-tightly contacting an upper outer wall of the tube-shaped main body 100, an inner thread 304 formed below the seal wall 303 and engaged with the outer thread 304 of the tube-shaped main body 100, and an opening identification skirt 306 formed below the inner thread 304 and engaged under the outer circumference protrusion 103. A cutting line 305 is formed between the inner thread 304 and the opening identification skirt 306.

The operating tube 200 is provided with a pleated expansible and flexible part 201 formed corresponding to the pleated expansible and flexible part 202 and a through hole 202 formed under the through hole closing wall 104 of the main body 100 when the seal cap 300 is not opened. The operating tube 200 is further provided with a stopper protrusion 203 and an elongated air-introducing slot 204 formed from a portion above the upper end of the main body 100 to a portion below the stopper protrusion 203. The stopper protrusion 203 prevents the complete removal of the operating tube 200 from the container and allows the through hole 202 to be exactly located on and closed by the through hole closing wall 104 of the main body 100 when the operating tube 200 is pulled out of the container.

Figure 1B:
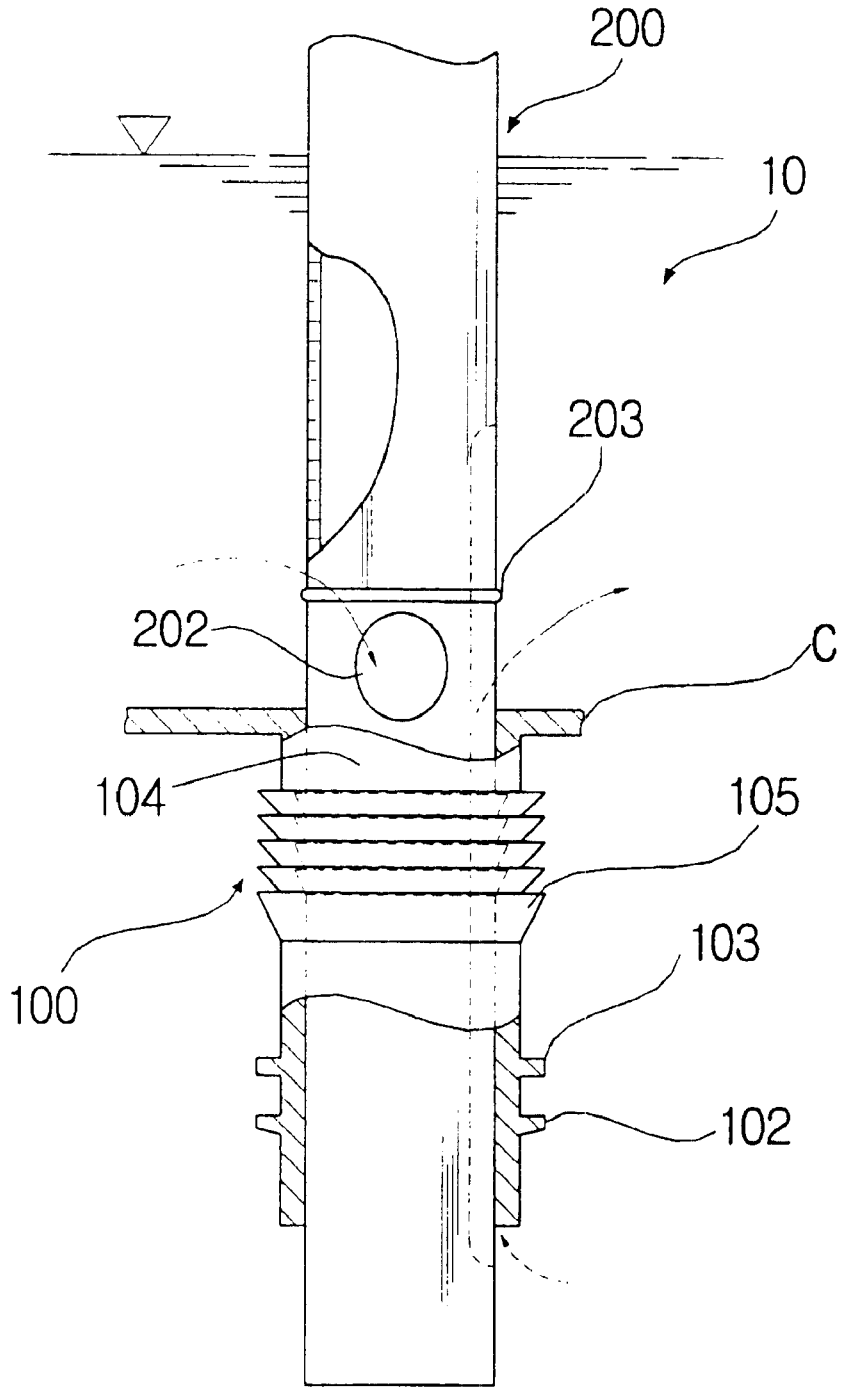
FIG. 1*b* is a partially sectional side view of a spout assembly of FIG. 1, in which a liquid container is overturned to dispense the liquid contained in the container into another container through the spout assembly.
Figure 1C:
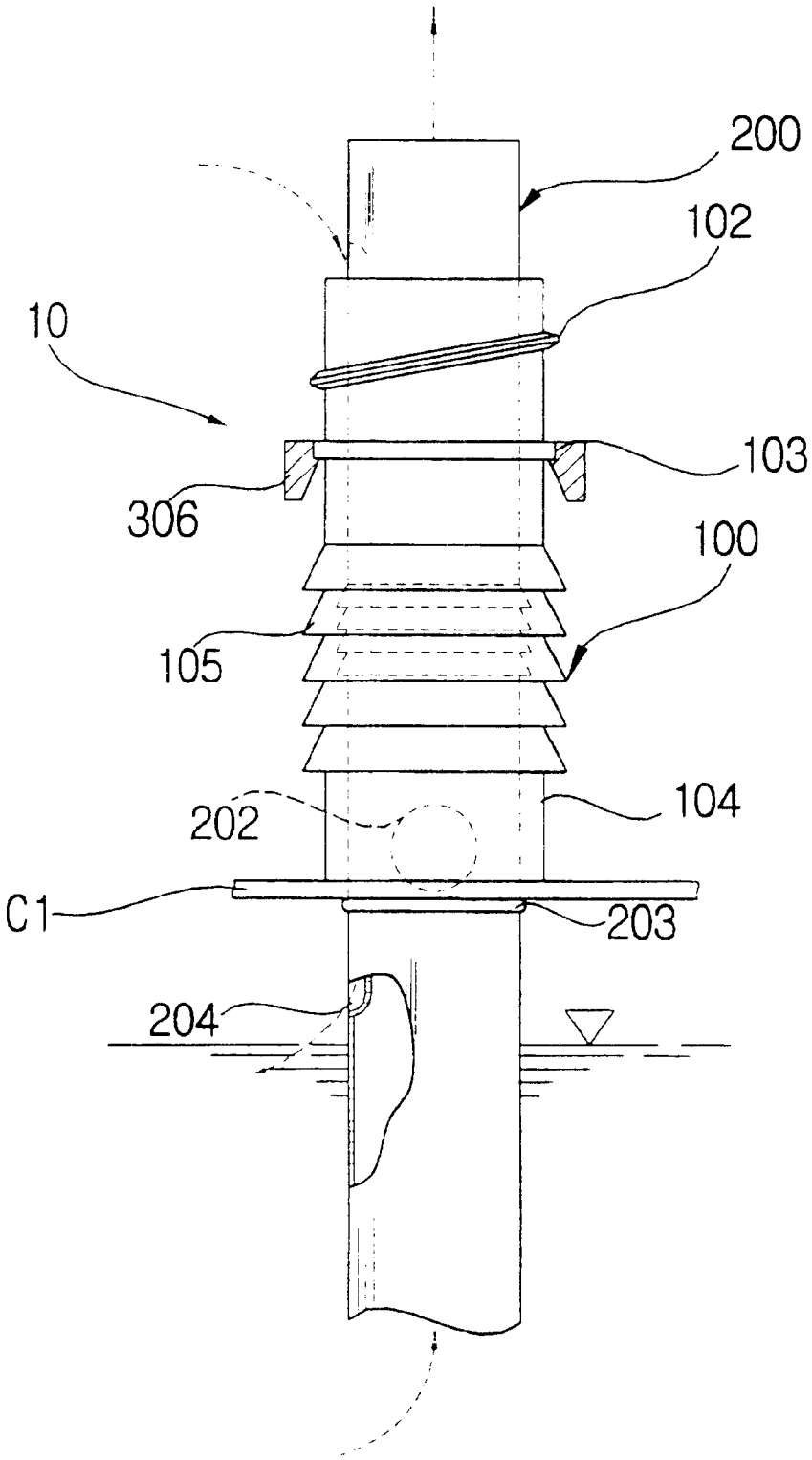
FIG. 1*c* is a side view of a spout assembly of FIG. 1, in which the spout assembly is vertically erected so that the user can draw the liquid contained in the container.
Figure 1D:
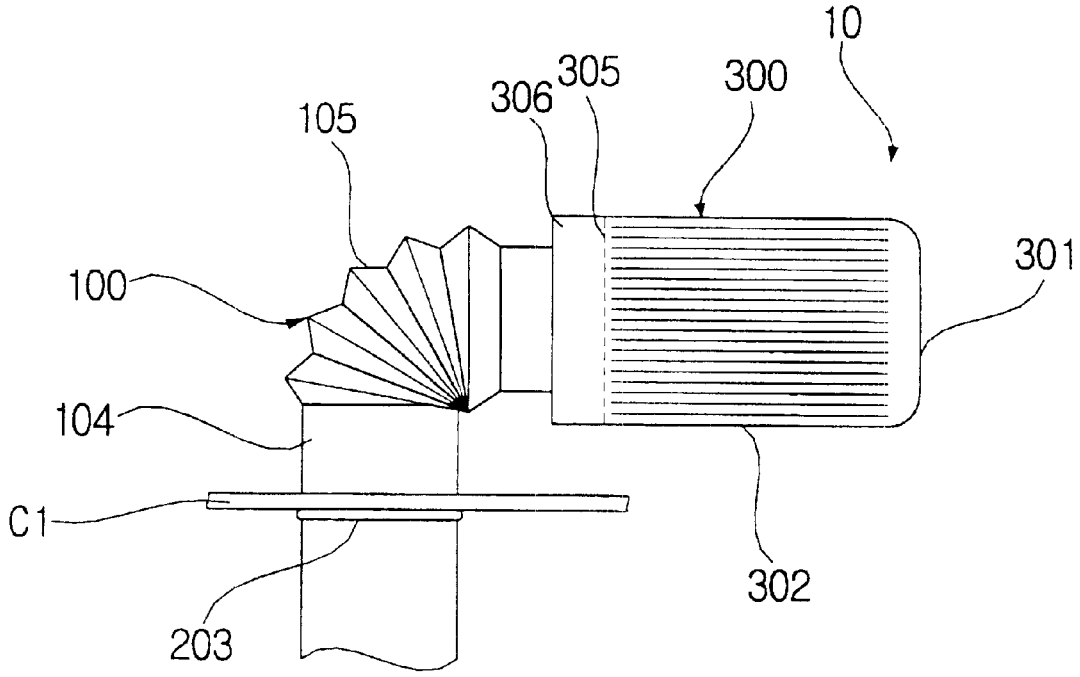
FIG. 1*d* is a side view of a spout assembly of FIG. 1, in which the spout assembly is bent to be secured in parallel with a top surface of the container or the container cap.
Figure 1E:
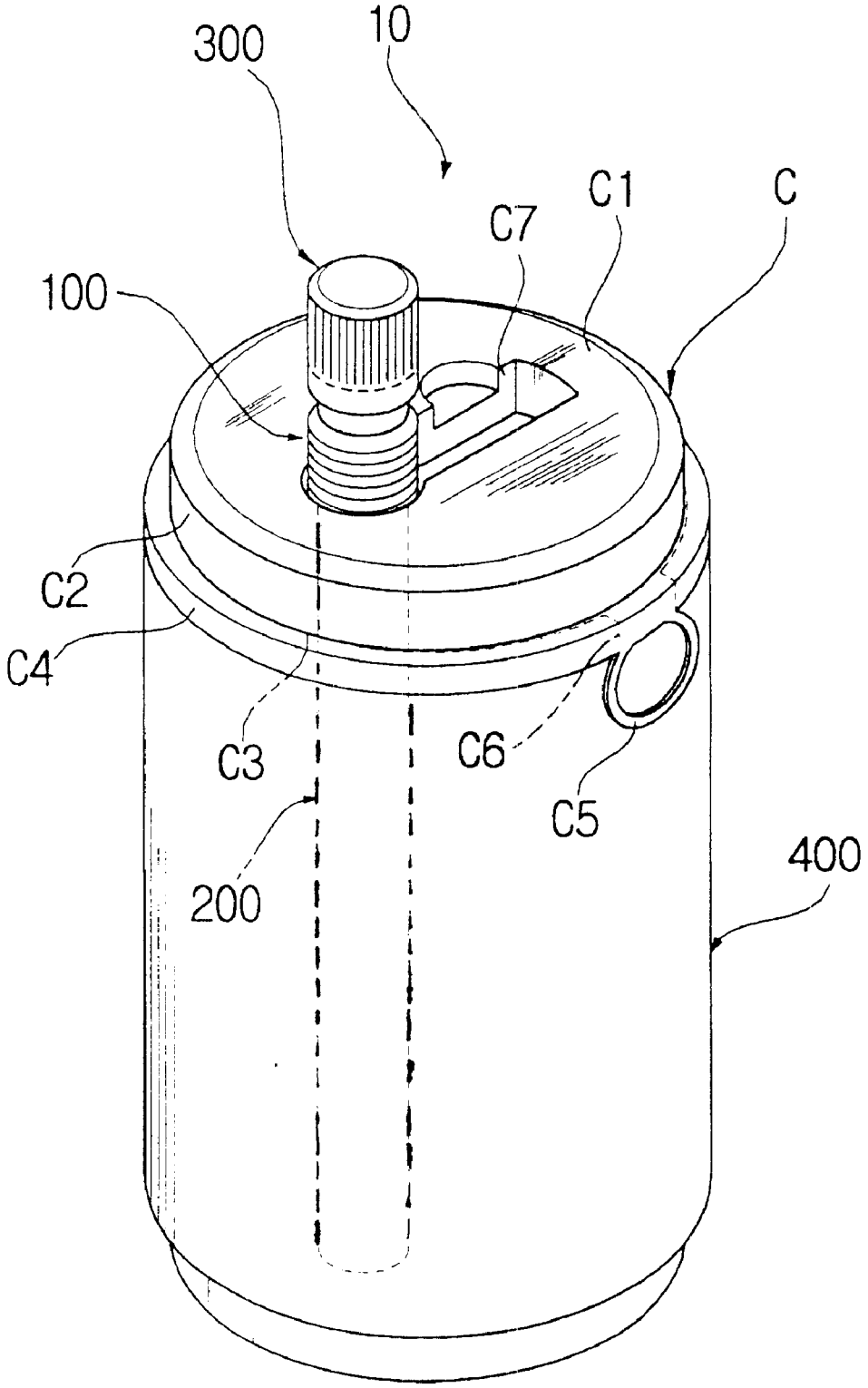
FIG. 1*e* is a perspective view of a liquid container with a container cap, which is integrated with a spout assembly according to a first embodiment of the present invention.

Referring to FIG. 1*e*, there is shown a container with the above described spout assembly 10. The container cap C is tightly fitted on an upper end of the container 400. The container cap C comprises a top portion C1, a side wall portion C2, and an opening identification skirt C4 formed extending from the lower end of the side wall portion C2. A preliminary cutting line C3 is formed between the sidewall portion C2 and the opening identification skirt C4. A finger grip C5 is formed on the opening identification skirt C4 and connected to the cutting line C3 through a cutting line C6.

The top portion C1 is provided with an indented portion defining a spout-receiving groove C7. That is, the main body 100 is integrally formed with a bottom of the indented portion.

In addition, the container 400 to which the spout assembly is employed can be selected from the group consisting of a pouch container, a paper-resin type container, a synthetic resin container, and an aluminum container.

Therefore, the spout assembly 10 can be disposed and secured parallel to a top portion, i.e., to a bottom surface of the indented portion of the container cap by bending the pleated expansible and flexible parts 105 and 202 of the respective main body 100 and the operation tube 200 (see FIG. 1*d*).

As described above, the spout assembly of the present invention is flexible between at least a first position where the spout assembly can be vertically erected on a top surface of the container or a container cap and a second position where the spout assembly can be secured on a top surface of the container in parallel with the same so that the liquid containers to which the spout assemblies are employed can be stacked on one another, thereby saving space.

The operation of the above described spout assembly will be described hereinafter.

In a state as shown in FIG. 1*d*, when the spout assembly 10 is vertically erected by adjusting the pleated expansible and flexible parts 105 and 202, the user can open the spout seal cap 300.

When the user opens the seal cap 300, the opening identification skirt 306 is maintained on the outer circumference protrusion 103.

In this state, when the user intends to drink the liquid contained in the container 400 through the operating tube 200, the operating tube 200 is pulled upward until the stopper protrusion 203 is caught by the top portion C1 of the container cap C so that the through hole 202 of the operating tube 200 is closed by the through hole closing wall 104 of the main body 100 (see FIG. 1*c*) Accordingly, when the user drinks the liquid through the operating tube 200, the liquid is drawn through the operating tube 200 and outer air is introduced into the container 400 through the elongated air-introducing slot 204, thereby making it easy for the user to draw the liquid in the container 400.

In addition, when the user intends to dispense the liquid contained in the container 400 into another container such as a cup, as shown in FIG. 1*b*, the operating tube 20 is first pushed downward until the through hole 202 is opened out of the through hole closing wall 104 of the main body 100. In this state, when the container 400 is overturned, the liquid flows into the operating tube 200 through the through hole 202, and is then dispensed into the cup. At this point, outer air is introduced into the container 400 through the elongated air-introducing slot 204, thereby enabling the liquid to exit the container 400 more effectively.

In addition, when the user intends to open the container cap C, the finger grip C5 is pulled while cutting the cutting lines C6 and C3 so that the container cap C can be removed from the container 400.

Since the container cap C is screw-coupled or fitted on the upper portion of the container, the container cap C can be reused to close-tightly close the container. The structure of the grip may be modified in a variety of shapes.

Figure 2:
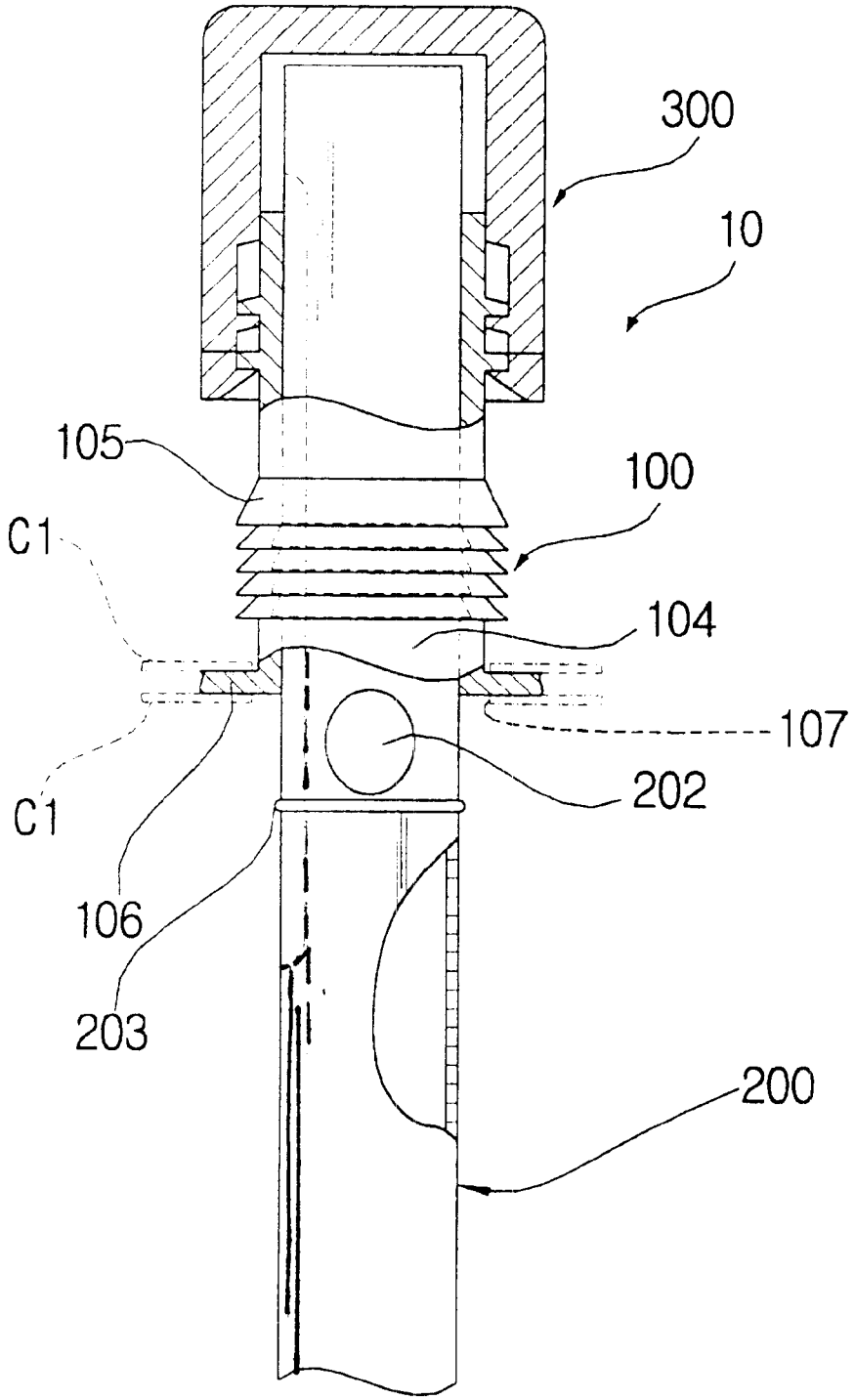
FIG. 2 is a partially sectional side view of a spout assembly according to a second embodiment of the present invention.

FIG. 2 shows a spout assembly according to a second embodiment of the present invention.

In the first embodiment, the main body 100 is integrally formed with the top portion C1 of the container cap C.

However, in this second embodiment, the top portion C1 of the container cap C is provided with an opening 107. An assembling flange 106 is formed on a lower end of the tube-shaped main body 100. The assembling flange 106 is attached or assembled on an inner or outer surface of the top portion C1 of the container cap C around the opening 107 such that the opening 107 communicates with the tube-shaped main body. When attaching the flange 106 on the top portion, a thermal or high-frequency heating process may be applied.

Figure 3:
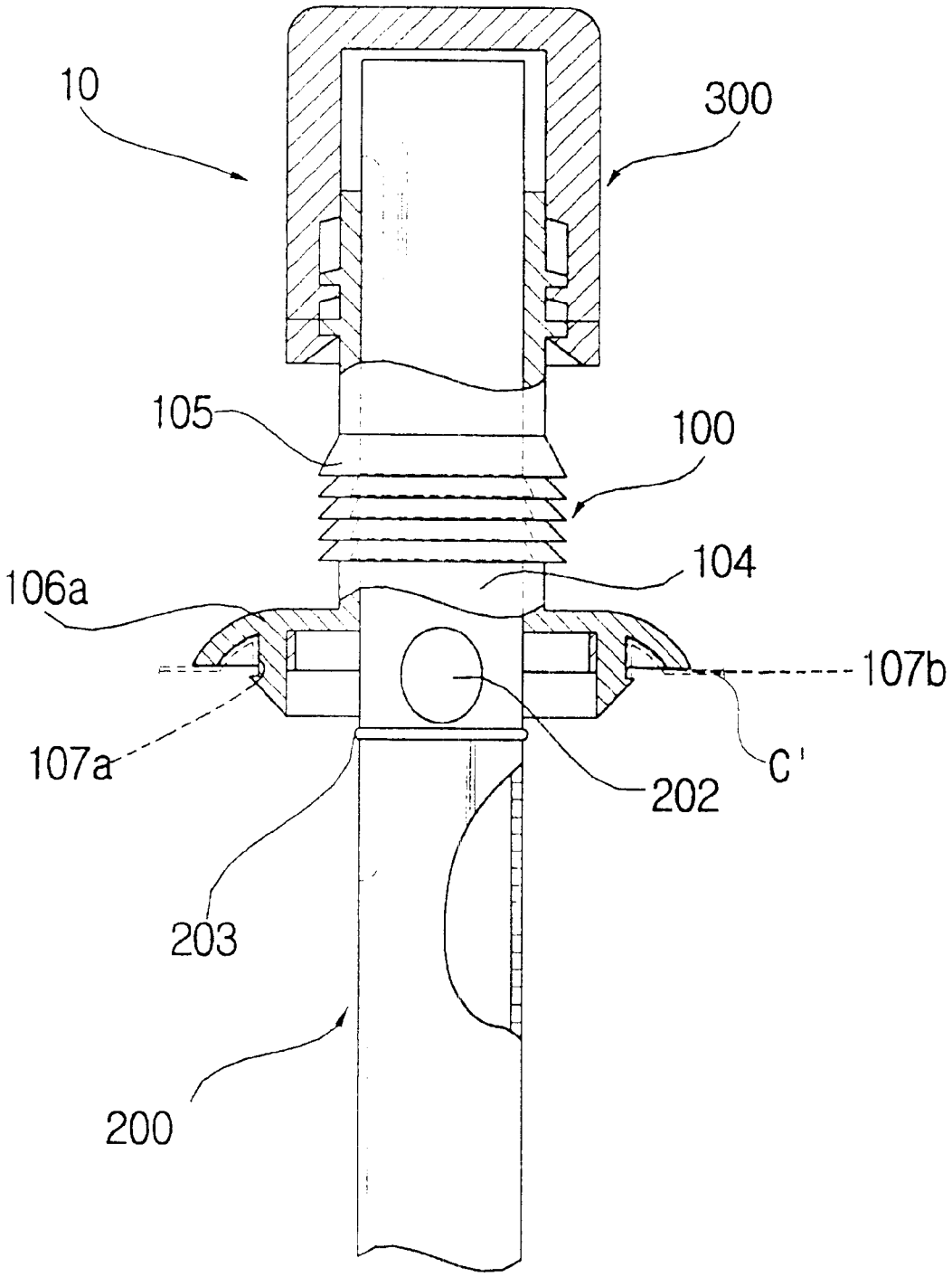
FIG. 3 is a partially sectional side view of a spout assembly according to a third embodiment of the present invention.

FIG. 3 shows a spout assembly according to a third embodiment of the present invention.

In this embodiment, an opening 107*a* is formed on the container cap C and a downward projection 107*b* is formed on a portion defining the opening 107*a*. A supporting flange 106*a* is formed on the lower end of the tub-shaped main body 100, and a hook projection 108 is formed extending downward from the lower surface of the supporting flange 106*a*. In a state where the supporting flange 106*a* supports the top surface C1, the hook projection 108 is inserted into the opening 107*a* such that it is hooked on the downward projection 107*b*. Preferably, a reinforcing ring 109 is fitted into an inner wall of the hook projection 108 so as to enhance the fitting force of the hook projection 108 on the downward projection 107*b* of the container cap C.

Figure 4:
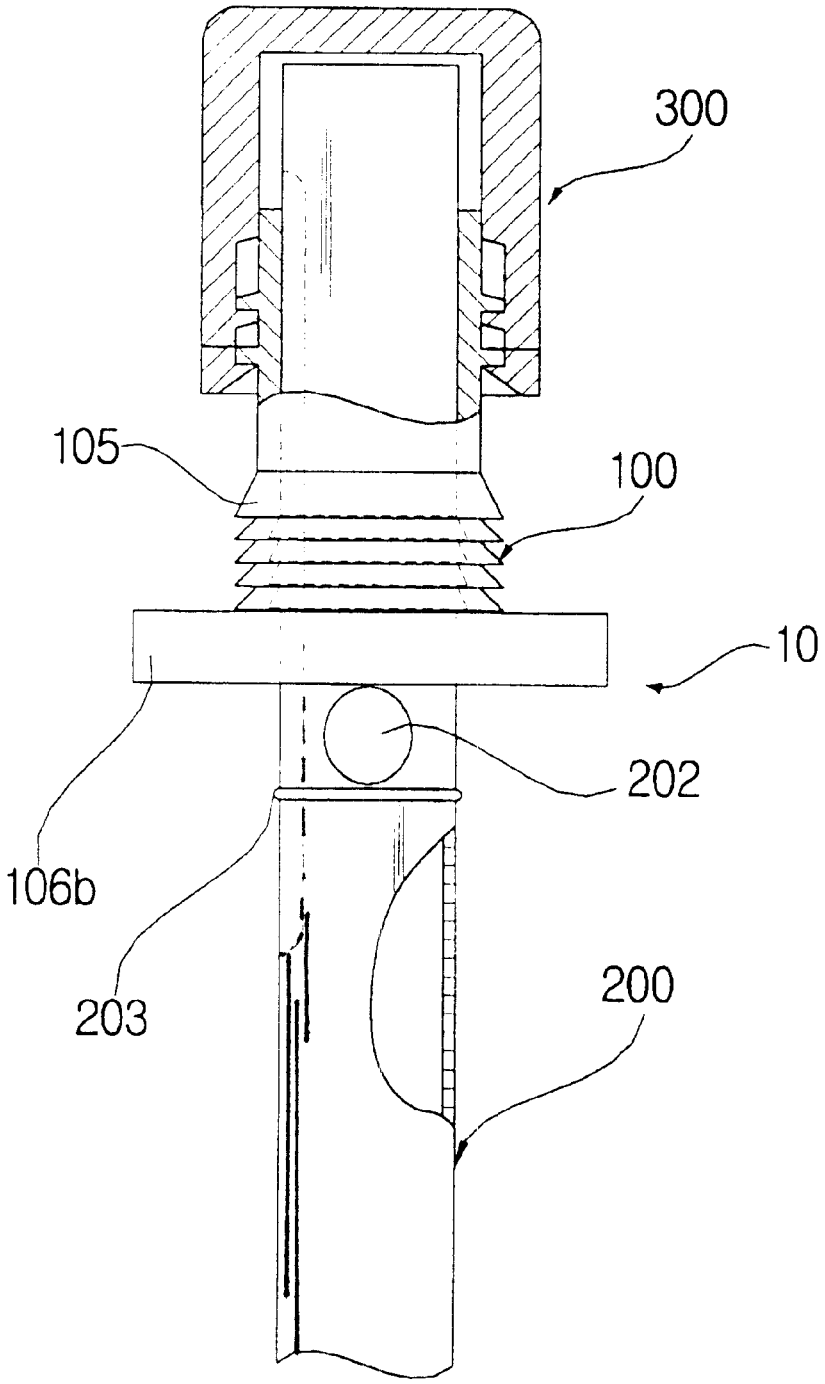
FIG. 4 is a partially sectional side view of a spout assembly according to a third embodiment of the present invention.

FIG. 4 shows a spout assembly according to a fourth embodiment of the present invention.

In this embodiment, an assembling flange 106*b* is formed extending radially outward on the through hole closing wall portion of the main body 100. The assembling flange 106*b* may be preferable when a pouch is used as the container.

Figure 5:
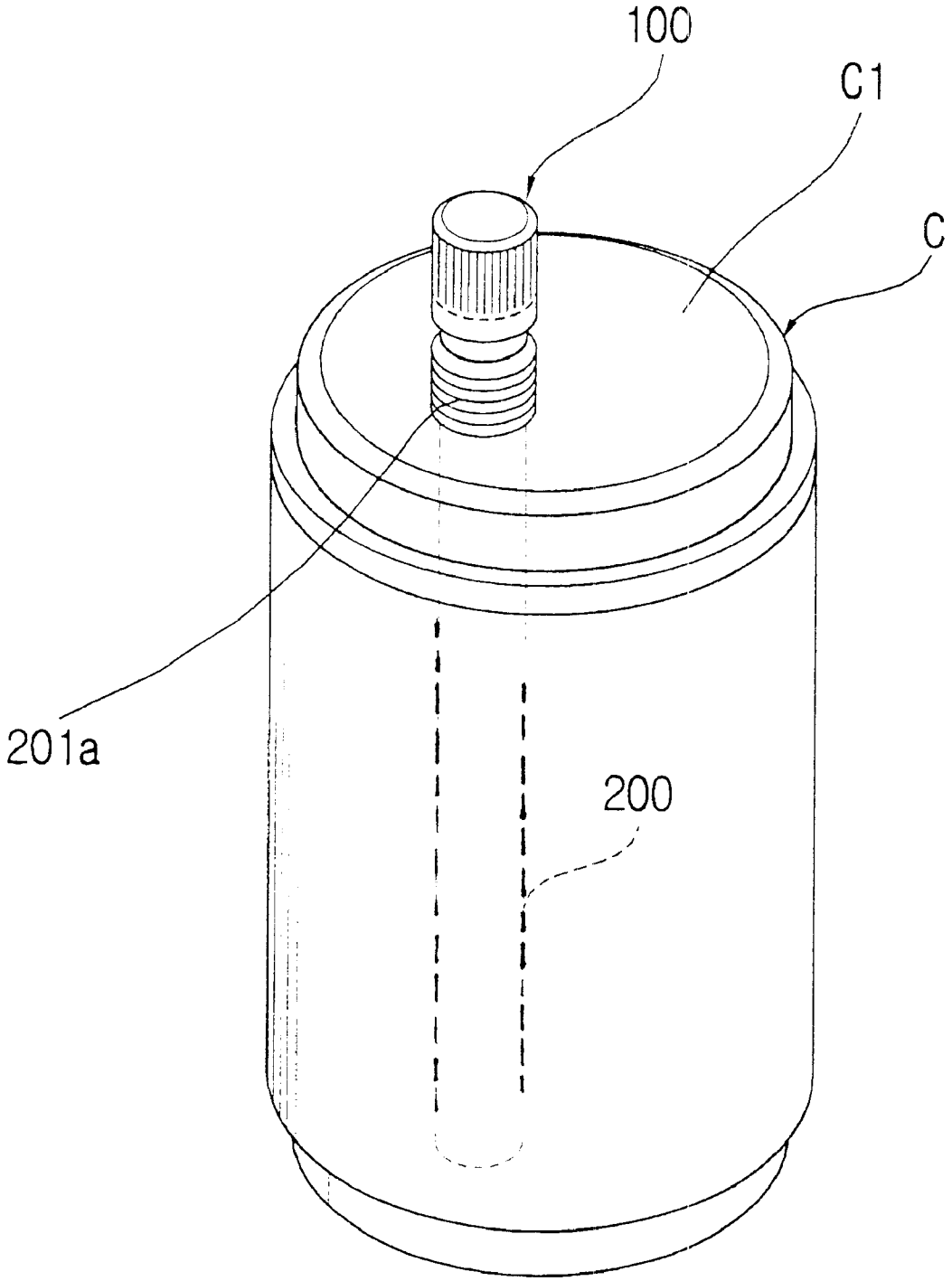
FIG. 5 is a perspective view of a liquid container with a spout assembly according to a fourth embodiment of the present invention.

FIG. 5 shows a spout assembly according to a fifth embodiment of the present invention.

As shown in the drawing, the top portion C1 of the container cap C is not provided with the indented portion. In addition, a pleated expansible and flexible portion 201*a* of the main body 100 is attached on or integrally formed with the top portion C1 of the container cap C.

Figure 6:
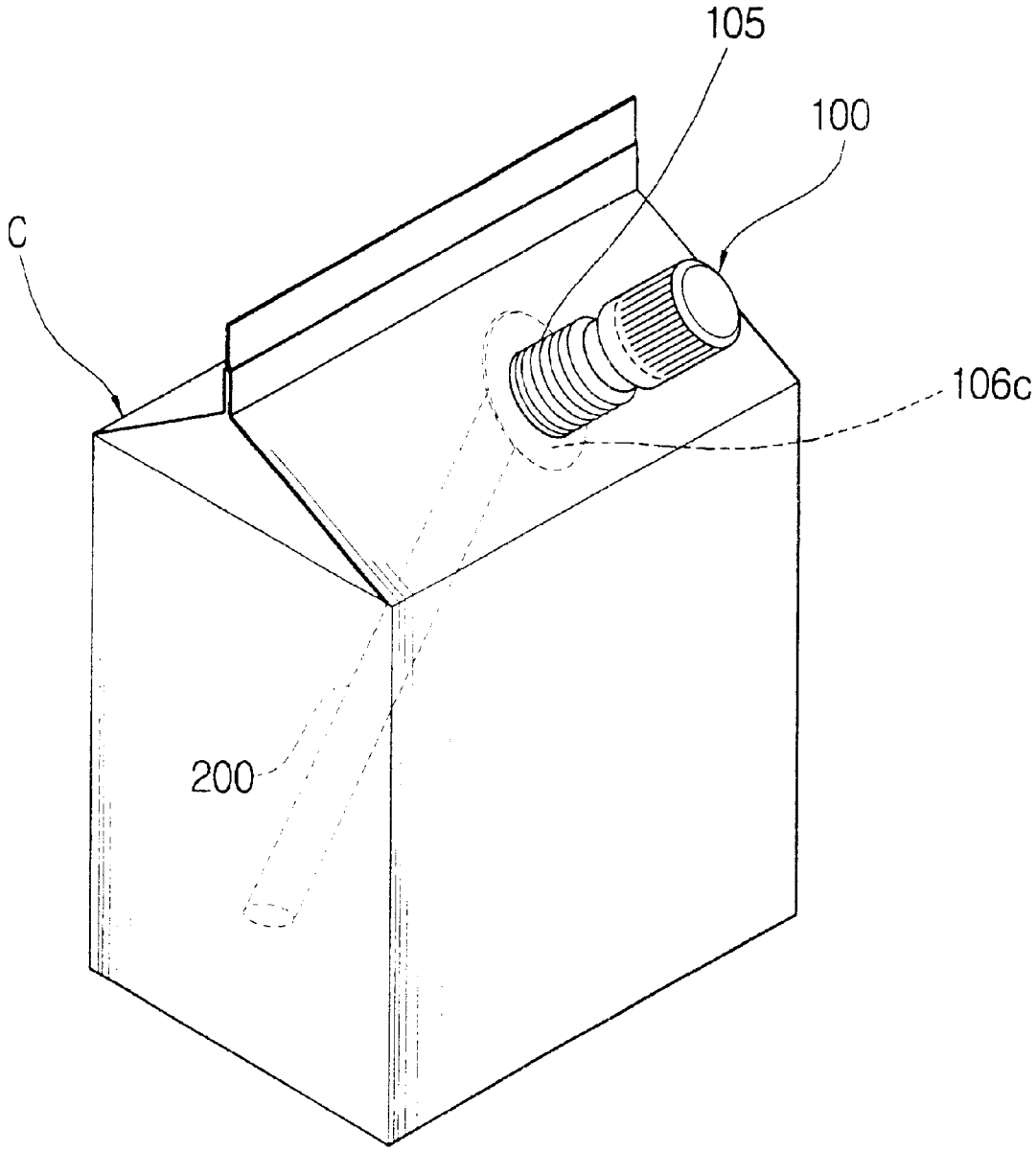
FIG. 6 is a perspective view of a liquid container with a spout assembly according to a sixth embodiment of the present invention.

FIG. 6 shows a spout assembly applied to a paper-resin type container according to a sixth embodiment.

As shown in the drawing, a paper-resin type container has a sealed top S. An opening is formed on one side surface of the sealed top S, and an assembling flange 106C of the main body is attached on the one side surface around the opening. This shows that the spout assembly of the present invention can be employed to any type of container.

As described above, since pleated expansible and flexible portions are provided to the main body and the operating tube, the spout assembly can be movable between at least a first position where the spout assembly can be vertically erected on a top surface of the container or a container cap and a second position where the spout assembly can be secured on a top surface of the container in parallel with the same. Also, this allows the liquid containers to which the spout assemblies are employed to be stacked on one another, thereby saving space.

In addition, since the operating tube is provided with a through hole, the liquid beverage in the container can be easily dispensed into another container such as a cup, and easily and conveniently drawn by the user in the manner that a straw is used.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A spout assembly for a liquid container, comprising:

a tube-shaped main body formed on a container cap and projected upward by a predetermined length; an operating tube inserted into the tube-shaped main body and extending into a container by a predetermined length;

a spout seal cap fitted on an upper portion of the tube-shaped main body; and a first pleated expansible and flexible part provided on the main body and a second pleated expansible and flexible part provided on the operating tube to correspond to the first pleated expansible and flexible part for moving the tube-shaped main body and the operating tube between a first position where the main body and the operating tube can be vertically erected on a surface of the container cap and a second position where the main body and the operating tube can be secured parallel to the surface of the container cap.

2. A spout assembly of claim 1 wherein the tube-shaped main body is integrally formed with the container cap.

3. A spout assembly of claim 1 wherein the container cap is integrally formed with the liquid container.

4. A spout assembly of claim 1 wherein the tube-shaped main body is provided with an assembling flange at it lower end, the assembling flange being assembled on the container cap around an opening formed on the container cap.

5. A spout assembly of claim 4 wherein the assembling flange is attached on one of inner and outer surfaces of the container cap.

6. A spout assembly of claim 1 wherein the spout seal cap comprises a seal wall close-tightly contacting an upper outer wall of the tube-shaped main body and an inner thread formed below the seal wall and engaged with an outer thread formed on the tube-shaped main body.

7. A spout assembly of claim 6 wherein the spout seal cap further comprises an opening identification skirt formed below the inner thread and engaged under an outer circumference protrusion formed on the main body below the outer thread.

8. A spout assembly of claim 7 wherein a cutting line is formed between the inner thread and the opening identification skirt.

9. A spout assembly of claim 1 wherein the container to which the spout assembly is employed is selected from the group of a pouch container, a paper-resin container, a synthetic resin container, and an aluminum container.

10. A spout assembly of claim 1 wherein the container cap is provided with an indented portion defining a spout assembly receiving groove when the main body and the operating tube are flexed parallel to the surface of the container cap.

11. A spout assembly for a liquid container, comprising:

a tube-shaped main body formed on a container cap and projected upward by a predetermined length, wherein the tube-shaped main body is provided with a supporting flange and a hook projection formed extending downward from the lower surface of the supporting flange, the supporting flange supporting the outer surface of the container cap, and the hook projection being inserted into an opening formed on the container cap and hooked on a downward projection formed extending downward from a portion defining the opening;

an operating tube inserted into the tube-shaped main body and extending into a container by a predetermined length;

a spout seal cap fitted on an upper portion of the tube-shaped main body; and means for moving the tube-shaped main body and the operating tube between a first position where the main body and the operating tube can be vertically erected on a surface of the container cap and a second position where the main body and the operating tube can be secured parallel to the surface of the container cap.

12. A spout assembly of claim 11 wherein a reinforcing ring is fitted into an inner wall of the hook projection so as to enhance the fitting force of the hook projection on the downward projection of the container cap.

13. A spout assembly for a liquid container, comprising:

a tube-shaped main body formed on a container cap and projected upward by a predetermined length;

an operating tube inserted into the tube-shaped main body and extending into a container by a predetermined length, wherein the operating tube is provided with a through hole and the main body is provided with a through hole closing wall, the through hole selectively communicating with an interior of the Container or being closed by the through hole closing wall according to a vertical movement of the operating tube;

a spout seal cap fitted on an upper portion of the tube-shaped main body; and means for moving the tube-shaped main body and the operating tube between a first position where the main body and the operating tube can be vertically erected on a surface of the container cap and a second position where the main body and the operating tube can be secured parallel to the surface of the container cap.

14. A spout assembly of claim 13 wherein the operating tube is further provided with a stopper protrusion formed below the through hole, the stopper protrusion preventing the operating tube from being completely removed from the container and allowing the through hole to be exactly located and closed by the through hole closing wall of the main body when the operating tube is pulled out of the container.

15. A spout assembly of claim 14 wherein the operating tube is further provided with an elongated air introducing slot extending from a portion above the upper end of the main body to a portion below the stopper protrusion.

16. A spout assembly for a liquid container, comprising:

a tube-shaped main body formed on a container cap and projected upward by a predetermined length;

an operating tube inserted into the tube-shaped main body and extending into a container by a predetermined length;

a spout seal cap fitted on an upper portion of the tube-shaped main body; and means for moving the tube-shaped main body and the operating tube between a first position where the main body and the operating tube can be vertically erected on a surface of the container cap and a second position where the main body and the operating tube can be secured parallel to the surface of the container cap, wherein the container cap comprises a top portion, a sidewall portion fitted on an upper portion of the container, and an opening identification skirt formed extending from the lower end of the sidewall portion.

17. A spout assembly of claim 16 wherein a preliminary cutting line is formed between the sidewall portion and the opening identification skirt.

18. A spout assembly of claim 17 wherein a finger grip is formed on the opening identification skirt and connected to the cutting line through a grip cutting line.

* * * * *